US011541527B2

(12) United States Patent
Kao

(10) Patent No.: US 11,541,527 B2
(45) Date of Patent: Jan. 3, 2023

(54) CONTAINER

(71) Applicant: Simon Kao, Tainan (TW)

(72) Inventor: Simon Kao, Tainan (TW)

( * ) Notice: Subject to any disclaimer, the term of this patent is extended or adjusted under 35 U.S.C. 154(b) by 124 days.

(21) Appl. No.: 17/141,716

(22) Filed: Jan. 5, 2021

(65) Prior Publication Data

US 2021/0354281 A1 Nov. 18, 2021

(30) Foreign Application Priority Data

May 12, 2020 (TW) ..... 109205760

(51) Int. Cl.
*B25G 1/08* (2006.01)
*B25B 15/02* (2006.01)
*B25B 23/00* (2006.01)

(52) U.S. Cl.
CPC ..... *B25G 1/085* (2013.01); *B25B 15/02* (2013.01); *B25B 23/0035* (2013.01)

(58) Field of Classification Search
CPC ..... B25G 1/085; B25G 1/08; B25B 15/02; B25B 23/0035; B25F 5/02
USPC ..... 81/438, 439, 490, 177.4
See application file for complete search history.

(56) References Cited

U.S. PATENT DOCUMENTS 6,305,255 B1 * 10/2001 Wu ..... B25G 1/085 81/439
6,601,483 B2 * 8/2003 Wannop ..... B25G 1/085 81/439
7,028,593 B1 * 4/2006 Lin ..... B25B 15/02 81/439
7,086,314 B2 * 8/2006 Wannop ..... B25G 1/085 81/439
2005/0092144 A1 * 5/2005 Shiao ..... B25G 1/085 81/490
2007/0251355 A1 * 11/2007 Kao ..... B25B 23/0035 81/177.4
2011/0138974 A1 * 6/2011 Arslan ..... B25G 1/085 81/440
2018/0015608 A1 * 1/2018 Cai ..... B25G 1/085
2022/0219294 A1 * 7/2022 Chen ..... B25B 23/0035
2022/0305636 A1 * 9/2022 Liu ..... B25B 23/0035

* cited by examiner

*Primary Examiner* — Lee D Wilson
*Assistant Examiner* — Jason Khalil Hawkins
(74) *Attorney, Agent, or Firm* — Muncy, Geissler, Olds & Lowe, P.C.

(57) ABSTRACT

A container includes a handheld body, a positioning rod, and a storage assembly. The handheld body defines a storage space. The positioning rod has at least one positioning part. The storage assembly includes a push-pull rod, a storage base, and a positioning member. The push-pull rod is operable to drive the positioning member to move therewith between a storage position, where the positioning member separably engages the at least one positioning part so as to position the storage base in the storage space, and an accessing position, where the positioning member is disengaged from the at least one positioning part.

7 Claims, 6 Drawing Sheets

CONTAINER

CROSS-REFERENCE TO RELATED APPLICATION

This application claims priority to Taiwanese Utility Model Patent Application No. 109205760, filed on May 12, 2020.

FIELD

The disclosure relates to a container, and more particularly to a container for storing tools.

BACKGROUND

A type of a conventional container, such as a storage box, is used for storing accessories of hand tools or handheld power tools (e.g., drill bits, screwdriver bits, pneumatic tool bits, and screwdriver bit adapters) when the accessories are removed from the hand tools or the handheld power tools (hereinafter also referred to as "the handheld tools"), indicating that the handheld tools are usually stored separately from the accessories and the conventional container. Since the accessories usually has a relatively small size, they are prone to be misplaced or lost if not stored together with the handheld tools. In addition, a user in possession of the handheld tools, might fail to get assistance from the accessories when the user mistakenly thinks the accessories have already been attached to the corresponding handheld tools, or when the user simply forgets to take the conventional container that stores the accessories.

In addition, another type of the conventional container, e.g., a pencil box, is used for storing stationery such as pencils, pens, rulers, etc. Such conventional container usually has a single-layer structure or a multi-layered structure which provides a relatively large space to separate the various stationery stored therein. However, the stationery is generally stored in such conventional container without being organized, and thus, a user might spend too much time to find the stationery that the user needs.

SUMMARY

Therefore, an object of the disclosure is to provide a container that can alleviate at least one of the drawbacks of the prior arts.

According to the disclosure, the container includes a handheld body, a positioning rod, and a storage assembly. The handheld body defines a storage space that extends in a front-rear direction and that opens toward a rear end of the handheld body. The positioning rod is fixedly mounted to the handheld body, and extends in the front-rear direction into the storage space. The positioning rod has at least one positioning part that is located in the storage space. The storage assembly includes a push-pull rod, a storage base, and a positioning member. The push-pull rod is telescopically connected to the positioning rod. The storage base is mounted to the push-pull rod, and is adapted for storage of an article. The positioning member is mounted to the push-pull rod. The push-pull rod is operable to drive the positioning member to move therewith in the front-rear direction relative to both of the handheld body and the positioning rod between a storage position, where the positioning member separably engages the at least one positioning part so as to position the storage base in the storage space, and an accessing position, where the positioning member is disengaged from the at least one positioning part and where the storage base is accessible.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
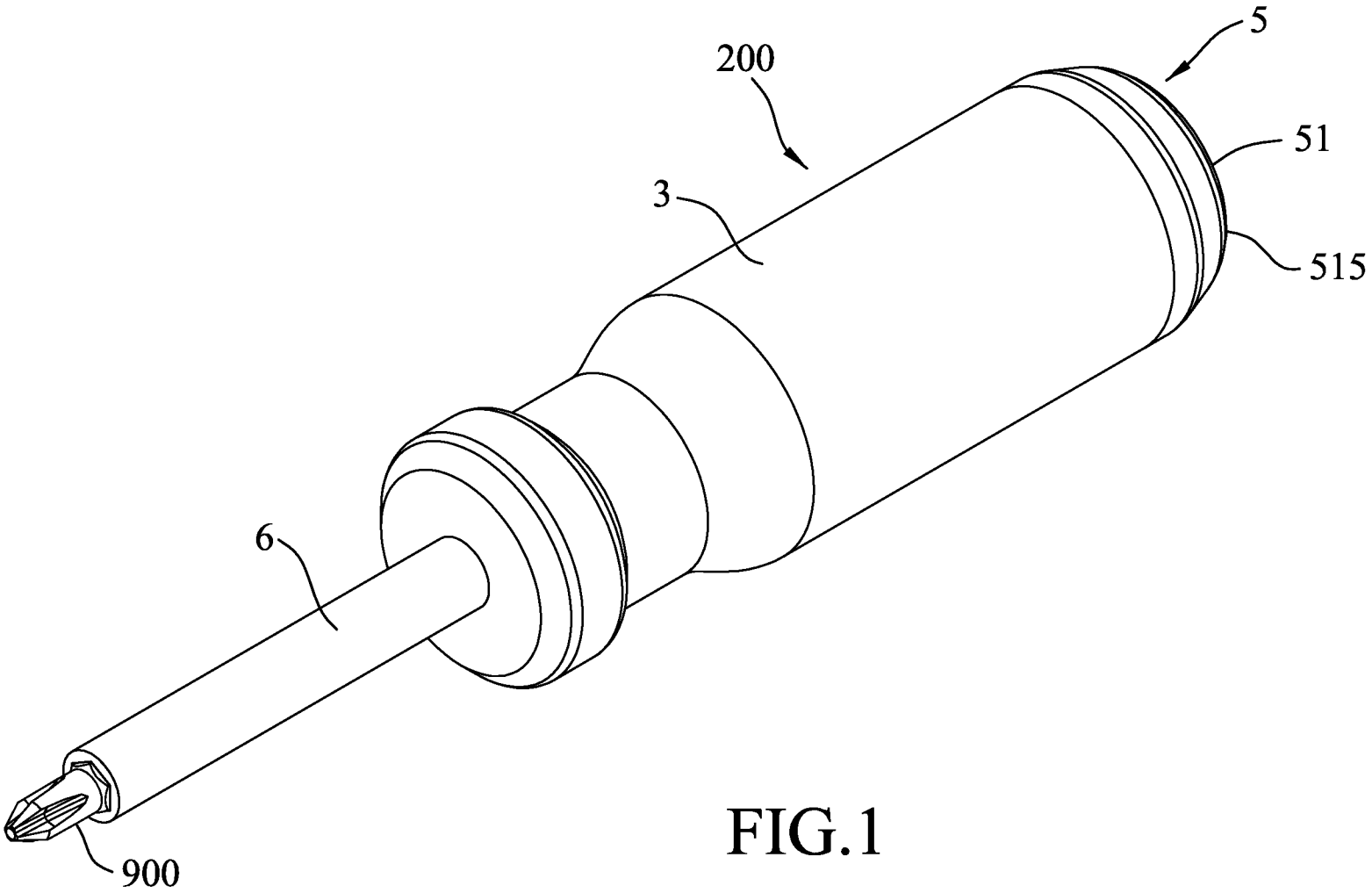
FIG. 1 is a perspective view illustrating an embodiment of a container according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
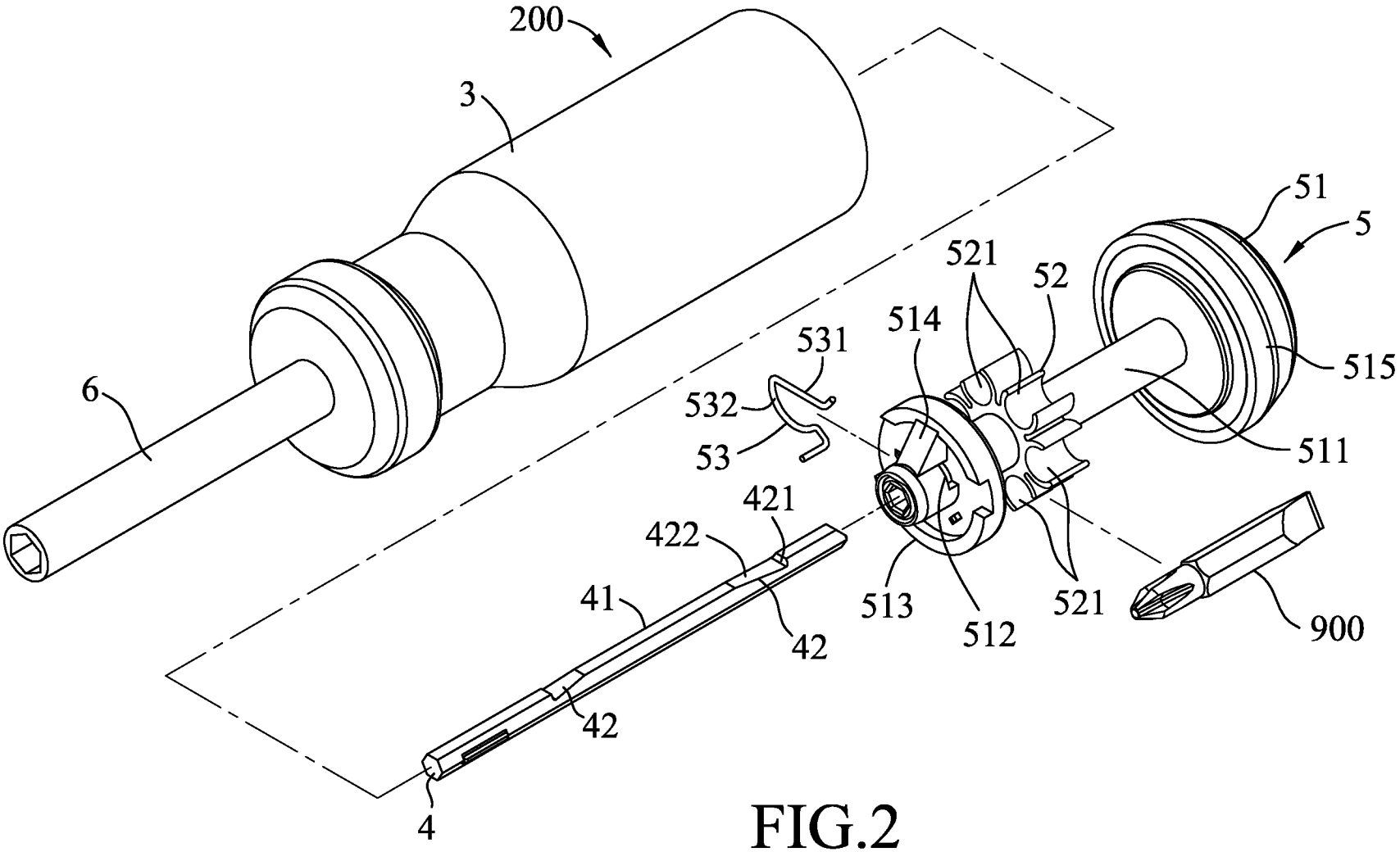
FIG. 2 is an exploded perspective view illustrating the embodiment.
Figure 4:
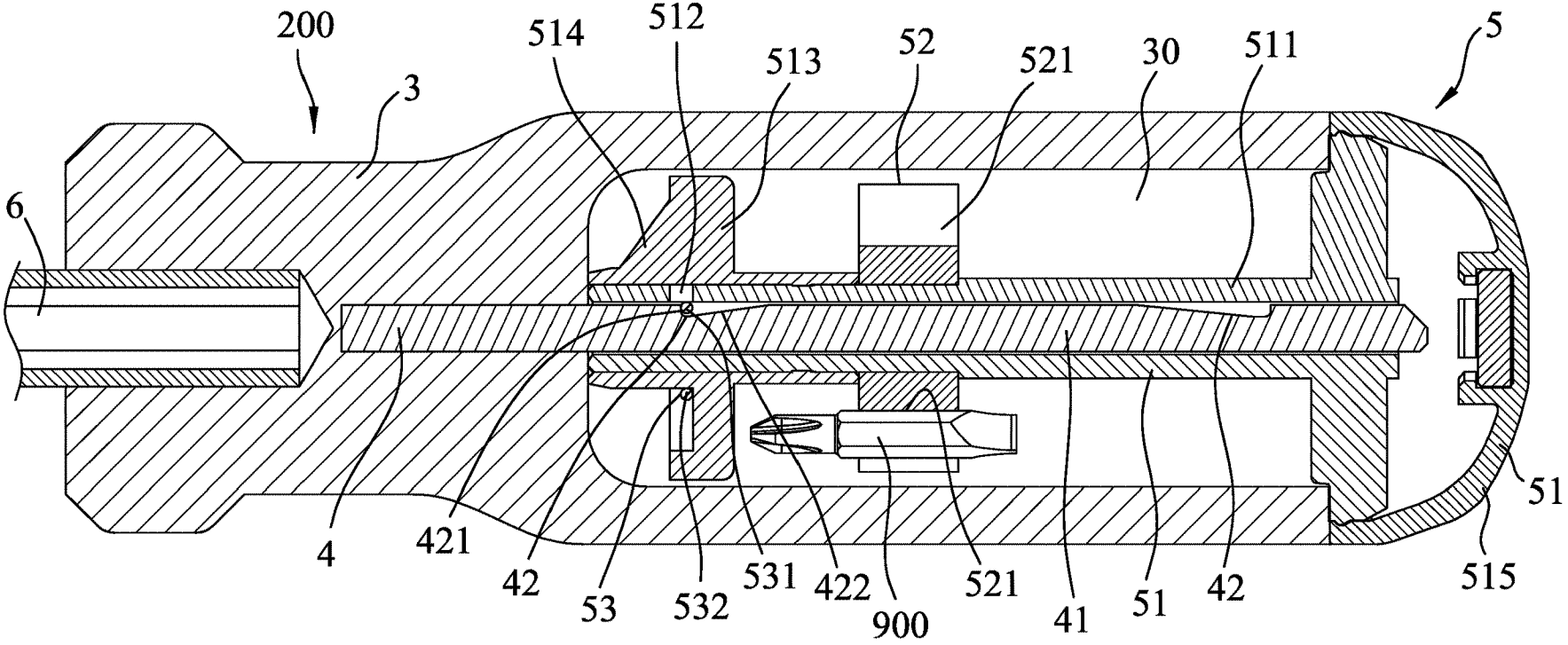
FIG. 4 is a fragmentary sectional side view illustrating a push-pull rod of the embodiment at a storage position.

Referring to FIGS. 1, 2 and 4, an embodiment of a container 200 according to the disclosure is adapted for storage of a plurality of articles 900. In this embodiment, the articles 900 are screwdriver bits, but are not limited thereto.

The container 200 includes a handheld body 3, a positioning rod 4, a storage assembly 5, and a mounting mechanism 6. The handheld body 3 defines a storage space 30 that extends in a front-rear direction and that opens toward a rear end of the handheld body 3. The positioning rod 4 is fixedly mounted to the handheld body 3, and extends in the front-rear direction into the storage space 30. The mounting mechanism 6 is disposed on a front end of the handheld body 3, and is adapted for one of the articles 900 to be separably mounted thereto.

In this embodiment, the positioning rod 4 has a rod body part 41 (see FIG. 2) that extends in the front-rear direction, and two positioning parts 42 that are spaced apart in the front-rear direction and that are located in the storage space 30. Each of the positioning parts 42 is a groove and is formed in an outer surface of the rod body part 41. Specifically, each of the positioning parts 42 has a blocking surface 421 and a sloping surface 422. For each one of the positioning parts 42: the blocking surface 421 extends in a radial direction of the positioning rod 4, and faces toward the other one of the positioning parts 42; and the sloping surface 422 extends radially outwardly and slantingly from an inner edge of the blocking surface 421 toward the other one of the positioning parts 42, and extends to the outer surface of the rod body part 41. The blocking surface 421 and the sloping surface 422 of each of the positioning parts 42 cooperate with each other to define the groove.

The storage assembly 5 includes a push-pull rod 51, a storage base 52, and a positioning member 53. The push-pull rod 51 extends in the front-rear direction, and surrounds and is telescopically connected to the positioning rod 4. The storage base 52 surrounds and is mounted to the push-pull rod 51, and is adapted for storage of the articles 900. The positioning member 53 is mounted to a front section of the push-pull rod 51, and is able to separably engage the abovementioned groove (i.e., either one of the positioning parts 42 of the positioning rod 4). The push-pull rod 51 is operable to drive the storage base 52 and the positioning member 53 to move therewith in the front-rear direction relative to both of the handheld body 3 and the positioning rod 4 between a storage position, where the positioning member 53 separably engages one of the positioning parts 42 so as to position the storage base 52 in the storage space 30 of the handheld body 3, and an accessing position, where the positioning member 53 is disengaged from the one of the positioning parts 42 and separably engages the other one of the positioning parts 42 and where the storage base 52 is accessible.

The push-pull rod 51 of the storage assembly 5 includes a tubular body part 511, a flange part 513, a limiting part 514, and a cover part 515. The tubular body part 511 extends and is movable in the front-rear direction, and surrounds the rod body part 41 of the positioning rod 4. The flange part 513 is ring-shaped, and is disposed on and extends radially outwardly from an exterior surface of a front section of the tubular body part 511. The limiting part 514 is connected to the exterior surface of the front section of the tubular body part 511 and to a front surface of the flange part 513. The cover part 515 is connected to and extends radially outwardly from a rear end of the tubular body part 511, and abuts the rear end of the handheld body 3 when the push-pull rod 51 is at the storage position so as to block an open end of the storage space 30 of the handheld body 3.

Figure 3:
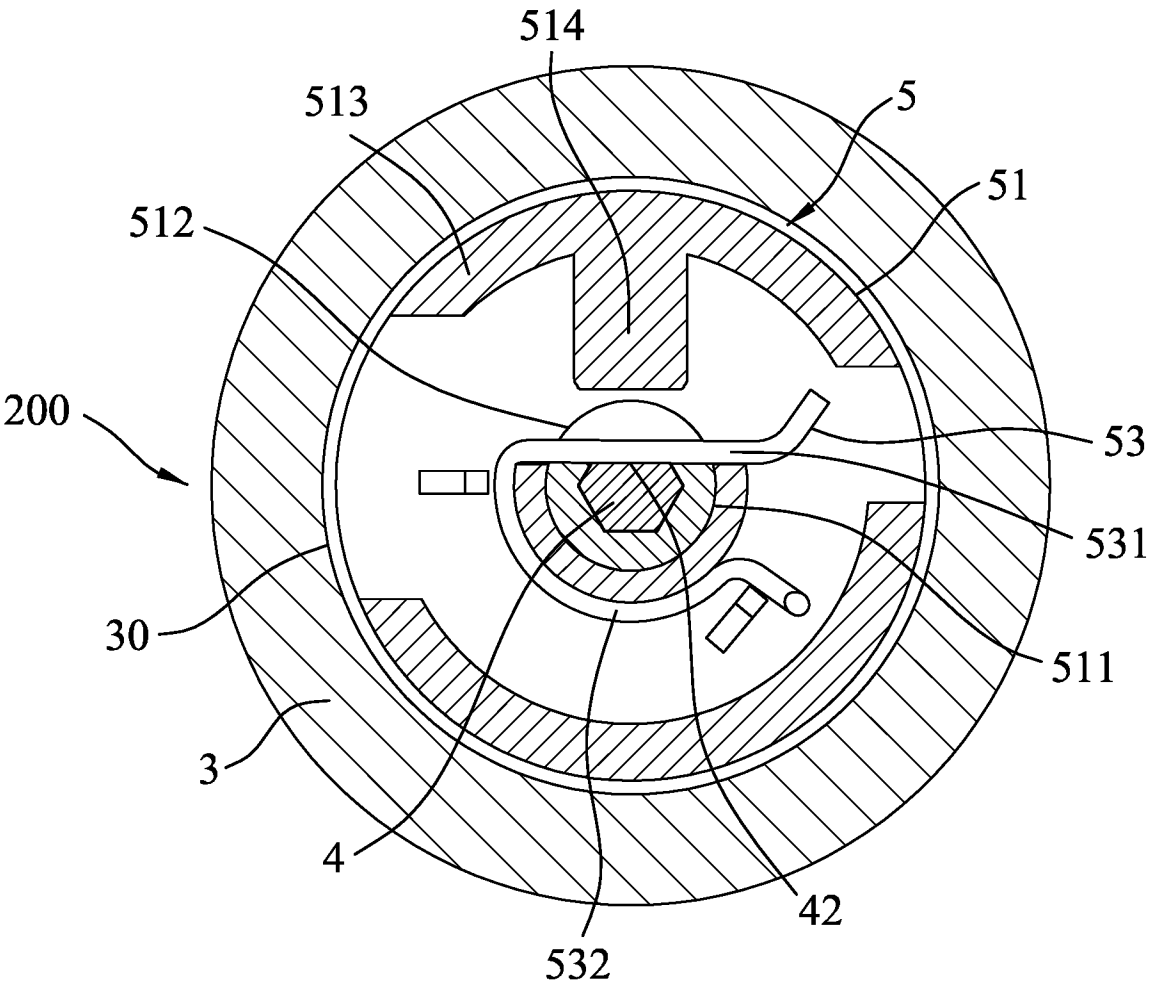
FIG. 3 is a sectional front view illustrating the embodiment.

Referring to FIG. 3, in combination with FIGS. 1, 2 and 4, the tubular body part 511 of the push-pull rod 51 of the storage assembly 5 has a through groove 512 that is formed in the front section of the tubular body part 511, and that extends in a circumferential direction of the tubular body part 511. The limiting part 514 of the push-pull rod 51 partly blocks a radially exterior side of the through groove 512. The storage base 52 of the storage assembly 5 includes a plurality of storage parts 521 (see FIG. 2) that surround the tubular body part 511 of the push-pull rod 51, and that are spaced apart from one another about an axis of the tubular body 511. Each of the storage parts 521 is adapted for storage of one of the articles 900. In this embodiment, each of the storage parts 521 has a C-shaped cross-section, and grips the one of the articles 900 for positioning and storage thereof. However, in other embodiments, storage parts 521 may be shaped differently, e.g., having a ring-shaped cross-section, so that the articles 900 can be inserted therein for storage.

The positioning member 53 of the storage assembly 5 is a resilient member, penetrates an interior surface of the push-pull rod 51 of the storage assembly 5, and has a biasing section 531 that is rod-shaped, and a mounting section 532. The biasing section 531 is movable substantially in the radial direction of the positioning rod 4, penetrates the through groove 512 of the push-pull rod 51, and is limited substantially within the through groove 512 by the limiting part 514 of the push-pull rod 51. The mounting section 532 is mounted outside of the tubular body part 511 of the push-pull rod 51, and abuts against the flange part 513 of the push-pull rod 51, so as to constantly provide a restoring force for the biasing section 531 to substantially move radially inwardly relative to the tubular body part 511. Therefore, the positioning member 53 can be driven to move with the push-pull rod 51 to resiliently and separably engage either one of the positioning parts 42 of the positioning rod 4, so as to position the push-pull rod 51 at the corresponding one of the storage position and the accessing position.

The mounting mechanism 6 is disposed on the front end of the handheld body 3 and shares the same axis therewith. Therefore, the mounting mechanism 6 can be driven by the handheld body 3 to synchronously rotate, and further drives the one of the articles 900 that is separably mounted to the mounting mechanism 6 to synchronously rotate. Since the functions of the mounting mechanism 6 (e.g., providing a structure that one of the articles 900 can separably engage, adjusting rotary motion of one of the articles 900 in only one direction according to requirements, and adjusting an inner diameter thereof according to different outer diameters of the articles 900) are widely understood by those skilled in the art, further details thereof are not provided herein for the sake of brevity.

Figure 5:
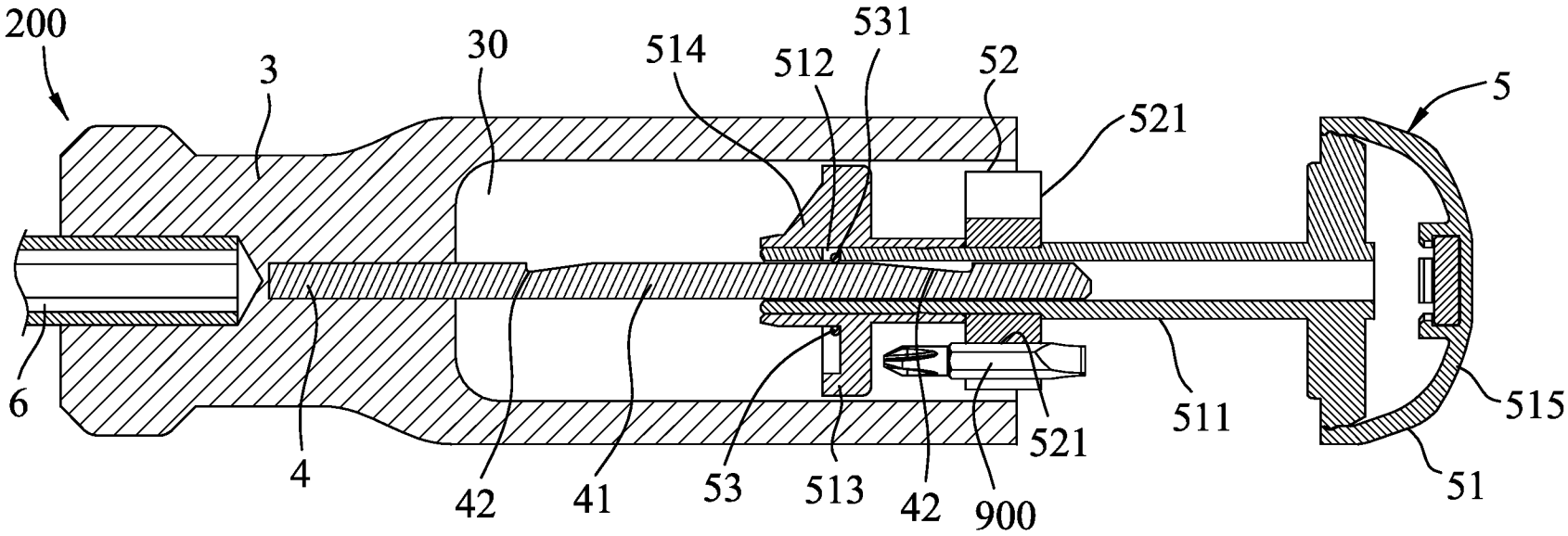
FIG. 5 is a fragmentary sectional side view illustrating a positioning member being disengaged from one of positioning parts.
Figure 6:
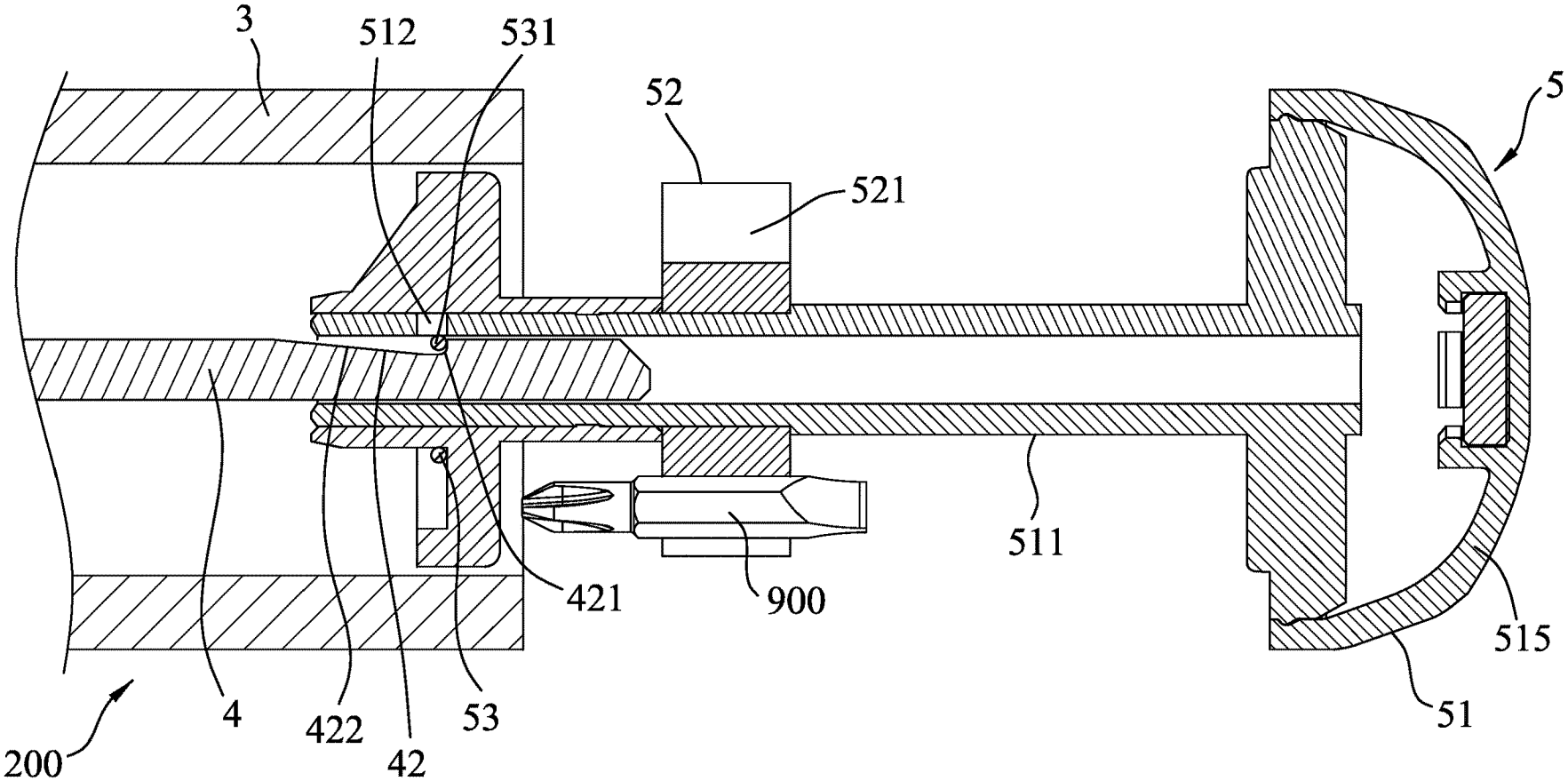
FIG. 6 is a fragmentary sectional side view illustrating the push-pull rod of the embodiment at an accessing position.

Referring to FIGS. 4 to 6, when one of the articles 900 stored in the container 200 is required to be taken out therefrom, the cover part 515 of the push-pull rod 51 of the storage assembly 5 is pulled rearwardly relative to the handheld body 3 so that the push-pull rod 51 is able to drive the storage base 52 and the positioning member 53 of the storage assembly 5 to move therewith rearwardly relative to both of the handheld body 3 and the positioning rod 4. When the positioning member 53 is driven by the push-pull rod 51 to move rearwardly and leaves the storage position (i.e. being disengaged from the one of the positioning parts 42 of the positioning rod 4), the biasing section 531 of the positioning member 53 is pushed radially outwardly along the sloping surface 422 of the one of the positioning parts 42 and along the outer surface of the rod body part 41 of the positioning rod 4 by the positioning rod 4, so that the biasing section 531 gradually moves radially outwardly. With the restoring force provided by the mounting section 532 of the positioning member 53, the biasing section 531 continuously abuts against the positioning rod 4.

Then, when the positioning member 53 is driven by the push-pull rod 51 to move rearwardly and reaches the sloping surface 422 of the other one of the positioning parts 42 of the positioning rod 4, the biasing section 531 gradually moves radially inwardly along the sloping surface 422 of the other one of the positioning parts 42. Even though the biasing section 531 is still pushed radially outwardly along the sloping surface 422 of the other one of the positioning parts 42 by the positioning rod 4, the biasing section 531 is able to move radially inwardly due to the restoring force and the sloping surface 422 of the other one of the positioning parts 42 that slants radially inwardly from the outer surface of the rod body part 41 to the inner edge of the blocking surface 421 of the other one of the positioning parts 42. In addition, the biasing section 531 still continuously abuts against the positioning rod 4.

Next, the biasing section 531 reaches the inner edge of the blocking surface 421 of the other one of the positioning parts 42 and abuts the blocking surface 421 of the other one of the positioning parts 42, so that the positioning member 53 separably engages the other one of the positioning parts 42 and the push-pull rod 51 is positioned at the accessing position. When the push-pull rod 51 is at the accessing position, the storage base 52 of the storage assembly 5 becomes accessible. Therefore, one of the articles 900 can be removed from the storage base 52 to be mounted to the mounting mechanism 6 (see FIG. 1).

When the one of the articles 900 has been taken out from the container 200, the push-pull rod 51 of the storage assembly 5 is able to move back to the storage position. The cover part 515 of the push-pull rod 51 is pushed forwardly relative to the handheld body 3, so that the push-pull rod 51 is able to drive the storage base 52 and the positioning member 53 of the storage assembly 5 to move therewith forwardly relative to both of the handheld body 3 and the positioning rod 4. Therefore, the positioning member 53 can be disengaged from the other one of the positioning parts 42 and then the positioning member 53 can separably engage the one of the positioning parts 42 again, so that the push-pull rod 51 is positioned at the storage position again and the open end of the storage space 30 of the handheld body 3 is blocked by the cover part 515.

In this embodiment, the push-pull rod 51 of the storage assembly 5 is positioned at either one of the storage position and the accessing position by the two positioning parts 42 of the positioning rod 4 which the positioning member 53 of the storage assembly 5 can separably engage. However, in other embodiments, the positioning rod 4 may only have one positioning part 42, or may have more than two positioning parts 42, as long as the push-pull rod 51 can be positioned at the storage position by one positioning part 42.

Furthermore, in this embodiment, the storage assembly 5 only includes one storage base 52. However, in other embodiments, the storage assembly 5 may have a plurality of storage bases 52, as long as any one of the storage bases 52 is accessible when the push-pull rod 51 of the storage assembly 5 is at the corresponding accessing position.

In addition, variations can be made to the positioning mechanism and the telescopic connection between the positioning rod 4 and the storage assembly 5 according to practical requirements. In certain embodiments, the mounting mechanism 6 may be omitted therefrom.

In summary, by virtue of the abovementioned structures and the arrangements of the handheld body 3, the positioning rod 4, and the storage assembly 5, when the push-pull rod 51 of the storage assembly 5 is pulled rearwardly from the storage position to the accessing position, the storage base 52 becomes accessible, so as to permit the articles 900 to be easily accessible and taken out from the container 200, or can be stored in the container 200 in required order. In addition, by having the mounting mechanism 6, the container 200 can also serve as a hand tool when any one of the articles 900 that are stored in the container 200 is mounted to the mounting mechanism 6. Therefore, a user requiring the handheld tools is ensured to be provided with the articles 900 simultaneously, thereby fulfilling the purpose of the disclosure.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A container comprising:

a handheld body defining a storage space that extends in a front-rear direction and that opens toward a rear end of said handheld body;

a positioning rod fixedly mounted to said handheld body, and extending in the front-rear direction into said storage space, said positioning rod having at least one positioning part that is located in said storage space; and a storage assembly including a push-pull rod that is telescopically connected to said positioning rod, a storage base that is mounted to said push-pull rod and that is adapted for storage of an article, and a positioning member that is mounted to said push-pull rod, said push-pull rod being operable to drive said positioning member to move therewith in the front-rear direction relative to both of said handheld body and said positioning rod between a storage position, where said storage base is positioned in said storage space, and an accessing position, where said storage base is accessible;

wherein said positioning rod has two of said positioning parts that are spaced apart in the front-rear direction, said positioning member of said storage assembly separably engaging one of said positioning parts when said push-pull rod of said storage assembly is at the storage position, said positioning member disengaging said one of said positioning parts and separably engaging the other one of said positioning parts when said push-pull rod is at the accessing position;

wherein each of said positioning parts of said positioning rod is a groove, said push-pull rod of said storage assembly surrounding said positioning rod, said positioning member of said storage assembly penetrating an interior surface of said push-pull rod and being resiliently movable to separably engage either one of said positioning parts so as to position said push-pull rod at the corresponding one of the storage position and the accessing position;

wherein said push-pull rod of said storage assembly includes a tubular body part that surrounds said positioning rod, and a limiting part that is connected to an exterior surface of a front section of said tubular body part, said tubular body part having a through groove that is formed in said front section of said tubular body part, and that extends in a circumferential direction of said tubular body part, said limiting part partly blocking a radially exterior side of said through groove, said positioning member of said storage assembly having a biasing section that is movable substantially in a radial direction of said positioning rod, that penetrates said through groove, and that is limited substantially within said through groove by said limiting part, and a mounting section that is mounted outside of said tubular body part so as to constantly provide a restoring force for said biasing section to substantially move radially inwardly relative to said tubular body part so that said positioning member can separably engage either one of said positioning parts; and wherein said push-pull rod of said storage assembly further includes a flange part that is disposed on and extends radially outwardly from the exterior surface of said front section of said tubular body part of said push-pull rod, and that is for abutting against said mounting section of said positioning member of said storage assembly.

2. The container as claimed in claim 1, wherein said positioning rod further has a rod body part that extends in the front-rear direction, said positioning parts of said positioning rod being formed in an outer surface of said rod body part, each of said positioning parts having a blocking surface that extends in a radial direction of said positioning rod and that faces toward the other one of said positioning parts, and a sloping surface that extends radially outwardly and slantingly from an inner edge of said sloping surface toward the other one of said positioning parts, and that extends to the outer surface of said rod body part, said blocking surface and said sloping surface of each of said positioning parts cooperating with each other to define the groove for being separably engaged with said positioning member.

3. The container as claimed in claim 2, wherein said push-pull rod of said storage assembly further includes a cover part that is connected to a rear end of said tubular body part of said push-pull rod, and that abuts the rear end of said handheld body when said push-pull rod is at the storage position so as to block an open end of said storage space of said handheld body.

4. The container as claimed in claim 1, wherein said push-pull rod of said storage assembly further includes a cover part that is connected to a rear end of said tubular body part of said push-pull rod, and that abuts the rear end of said handheld body when said push-pull rod is at the storage position so as to block an open end of said storage space of said handheld body.

5. The container as claimed in claim 1, wherein said storage base of said storage assembly includes a plurality of storage parts that surround said push-pull rod, and that are spaced apart from one another about an axis of said push-pull rod, each of said storage parts being adapted for storage.

6. The container as claimed in claim 1, further comprising a mounting mechanism that is disposed on a front end of said handheld body and that is adapted for the article to be separably mounted thereto.

7. The container as claimed in claim 1, wherein said positioning rod has at least three of said positioning parts that are spaced apart in the front-rear direction, said positioning member of said storage assembly separably engaging a frontmost one of said positioning parts when said push-pull rod of said storage assembly is at the storage position, said positioning member disengaging said frontmost one of said positioning parts and separably engaging one of the remaining said positioning parts when said push-pull rod is at the accessing position.

* * * * *